US010093481B2

(12) United States Patent
Snape

(10) Patent No.: US 10,093,481 B2
(45) Date of Patent: Oct. 9, 2018

(54) DISCHARGE ASSEMBLY

(71) Applicant: Process Link Limited, Warwickshire (GB)

(72) Inventor: George William Snape, Shipston-on-Stour (GB)

(73) Assignee: PROCESS LINK LIMITED, Shipston-on-Stour, Warwickshire (GB)

( * ) Notice: Subject to any disclaimer, the term of this patent is extended or adjusted under 35 U.S.C. 154(b) by 32 days.

(21) Appl. No.: 14/892,893

(22) PCT Filed: May 22, 2014

(86) PCT No.: PCT/GB2014/051582
§ 371 (c)(1),
(2) Date: Nov. 20, 2015

(87) PCT Pub. No.: WO2014/188205
PCT Pub. Date: Nov. 27, 2014

(65) Prior Publication Data
US 2016/0114972 A1 Apr. 28, 2016

(51) Int. Cl.
*B65D 88/66* (2006.01)
*B65B 69/00* (2006.01)
*B65D 88/16* (2006.01)

(52) U.S. Cl.
CPC ..... *B65D 88/66* (2013.01); *B65B 69/0091* (2013.01); *B65D 88/1612* (2013.01)

(58) Field of Classification Search
CPC .. B65D 88/66; B65D 88/1612; B65D 47/063; B65D 61/00; B65D 88/1668;
(Continued)

(56) References Cited

U.S. PATENT DOCUMENTS 4,946,071 A * 8/1990 Poulton ..... B65B 69/0091 141/314
4,966,311 A * 10/1990 Taylor ..... B65B 69/0091 222/105

(Continued)

FOREIGN PATENT DOCUMENTS

GB 2 439 945 1/2008
GB 2496939 5/2013

(Continued)

OTHER PUBLICATIONS

Great Britain Search Report dated Sep. 26, 2013 issued in Great Britain Patent Application No. 1309257.2, 3 pp.

(Continued)

*Primary Examiner* — Paul R Durand
*Assistant Examiner* — Robert Nichols, II
(74) *Attorney, Agent, or Firm* — Nixon & Vanderhye P.C.

(57) ABSTRACT

A discharge assembly has a flexible bulk container having a base and an outlet channel extending from the base and having an outlet at one end through which product is to be dispensed. The discharge assembly has a seat onto which the base of the bulk container is seated for a discharge operation, and a vibration unit for selectively vibrating the seat. The seat includes an outlet region through which the outlet channel of the bulk container extends when seated thereon, and the seat is configured for the base of the container to overhang a periphery of the seat when seated thereon.

15 Claims, 11 Drawing Sheets

(58) Field of Classification Search
CPC .... B65D 90/56; B65D 90/205; B65D 88/665; B65D 23/003; B65B 69/0091; B65B 69/0083; B65B 37/04
USPC ..... 222/173, 105, 196, 183.1
See application file for complete search history.

(56) References Cited

U.S. PATENT DOCUMENTS

| | | | | |
|---|---|---|---|---|
| 5,141,135 | A | 8/1992 | Volk, Jr. | |
| 5,306,876 | A | 4/1994 | Volk et al. | |
| 6,450,754 | B1 | 9/2002 | Catton | |
| 7,223,058 | B2 * | 5/2007 | Nyhof | B65B 69/0091 414/415 |
| 2003/0099530 | A1 | 5/2003 | Bonerb | |
| 2004/0206780 | A1 | 10/2004 | Sterner et al. | |
| 2007/0151625 | A1 | 7/2007 | Mahoney | |
| 2008/0014032 | A1 * | 1/2008 | Rillmann | B65D 88/28 406/87 |
| 2009/0008410 | A1 * | 1/2009 | Kosich | B65D 88/1668 222/105 |
| 2009/0010573 | A1 * | 1/2009 | Kosich | B65D 88/1668 383/22 |
| 2016/0167819 | A1 * | 6/2016 | Nakai | B02C 1/005 241/30 |

FOREIGN PATENT DOCUMENTS

| | | |
|---|---|---|
| JP | 2002-337982 | 11/2002 |
| WO | WO 2013/076482 | 5/2013 |

OTHER PUBLICATIONS

Great Britain Search Report dated Jul. 31, 2014 issued in Great Britain Patent Application No. 1409164.9, 7 pp.
International Search Report dated Jul. 15, 2014 issued in PCT International Patent Application No. PCT/GB2014/051582, 2 pp.

* cited by examiner

DISCHARGE ASSEMBLY

This application is the U.S. national phase of PCT International Application No. PCT/GB2014/051582 filed May 22, 2014 which designated the U.S. and claims priority to Great Britain Patent Application No. 1309257.2 filed May 22, 2013, the entire contents of each of which are hereby incorporated by reference.

TECHNICAL FIELD

The present invention relates to a discharge assembly and/or a method of discharging a bulk container.

BACKGROUND

A flexible intermediate bulk container (FIBC), sometimes called a "big bag" or "bulk bag", is a known term of art for a flexible container of the kind commonly used for transporting bulk quantities of loose, powdered or granular product, such as plastics, minerals, chemicals, agricultural products or foodstuffs. An example of an FIBC is indicated generally at 10 in FIGS. 1 and 2. The FIBC has a main body 16 in which product is stored and an outlet neck or channel 18 leading to an opening 12 through which product can be discharged.

To dispense product from the FIBC 10, the FIBC 10 is arranged with the outlet channel 18 lowermost. In some applications, the FIBC 10 is seated on a discharge device, with the outlet channel 18 extending through an aperture in the discharge device. Hence, the end face of the FIBC 10 (around the outlet channel 18) defines a base 15 of the FIBC 10. Typically, the discharge device is in the form of a rigid cone used to funnel the flow of product from the outlet of the FIBC. Commonly, a valve is arranged underneath the discharge device and in communication with the outlet channel of the FIBC 10, so that the product can be selectively released from the FIBC.

SUMMARY OF INVENTION

The present invention seeks to overcome or mitigate one or more problems associated with conventional discharge devices, particularly, but not exclusively, discharge devices used for dispensing product from an FIBC.

According to one aspect of the invention, there is provided a discharge assembly comprising:

- a flexible bulk container having a base and an outlet channel extending from the base and having an outlet at one end through which product is to be dispensed,
- a seat onto which the base of the container is seated for a discharge operation, the seat including an outlet region through which the outlet channel of the bulk container extends when seated thereon, and
- a vibration unit for selectively vibrating the seat;
- wherein the seat is configured for the base of the container to overhang a periphery of the seat when seated thereon.

The invention is primarily advantageous for the discharge of loose, powdered or granular product, such as plastics, minerals, chemicals, agricultural products or foodstuffs.

In exemplary embodiments, the area of the base of the container is effectively greater than the area defined by the periphery of the seat. Hence, when a full or partially full container is seated on the seat with the outlet sealed against discharge, product at the sides of the container will overhang the periphery of the seat. Moreover, this will create a tendency for some product within the container to 'lean' away from the outlet region of the seat (i.e. in the direction of the overhang).

It has been found that, once product is allowed to flow through the outlet of the container, product immediately above the outlet region will fall through the outlet. However, some material will remain stacked around the periphery of the outlet region. More particularly, the overhang has been found to produce a clear central region within the container (in effect, as if a central column of the product has been removed). If the vibration unit is then activated, the seat is vibrated and this has been found to cause material from the top of the 'stacked' product to begin to fall down through the void created by the initial discharge. This assembly and process has been found to facilitate a more controlled method of discharge from flexible bulk containers, in particular of the FIBC-type. Importantly, upon de-activation of the vibration unit, product remaining within the container tends to remain at rest within the container, again with a tendency to lean away from the axis of discharge (with the outlet channel free of product). This means that the outlet channel of the container can be tied off easily, making it easy to return a partially discharged container to storage.

In one embodiment, the seat has a flat upper surface (i.e. it is a flat plate).

In one embodiment, the seat is curved or angled downwardly from the outlet region towards an outer edge of the support plate.

In one embodiment, the seat includes a central aperture, which defines the outlet region.

In one embodiment, the seat is circular in plan view.

In one embodiment, the discharge device comprises a displacement member configured for movement away from the seat for agitation of the container.

In one embodiment, the displacement member is concentric with the seat and has in internal diameter greater than the outer diameter of the seat.

In one embodiment, a flexible wall extends between the displacement member and the seat.

In one embodiment, the wall extends between an inner edge of the displacement member and the periphery of the outlet region in the seat.

In one embodiment, the displacement member is configured to move from a retracted position to an extended position in which the wall defines a cone-shaped passageway for directing a flow of product from the container.

In one embodiment, an inner edge of the displacement member is spaced from the outer edge of the seat, to create a void into which the base of the container sags when the displacement member is in the retracted position.

In one embodiment, the spacing between the displacement member and the seat in the retracted position is at least in the region of 100 mm (e.g. in the region 100 mm to 300 mm).

In one embodiment, the discharge assembly comprises one or more actuators (e.g. hydraulic, pneumatic, or mechanical actuators) for movement of the displacement member relative to the seat.

In one embodiment, the discharge assembly comprises a detector for detecting product flow rate, an actuator for selectively raising the displacement member relative to the seat, and a controller configured to receive a signal from the detector and send a signal to the actuator indicating when the displacement member should be raised.

In one embodiment, the discharge assembly comprises a frame from which the container is suspended in order to sit on the seat.

In one embodiment, the frame comprises two parts: an upper part for connection of the upper end of a bulk container and a lower part including the seat.

In one embodiment, the upper part is movable relative to the lower part, for lifting the upper end of the bulk container away from the seat.

In one embodiment, the seat includes a projection yet spaced from said outlet region, which extends from the upper surface of the seat.

In one embodiment, the projection is spaced from the outlet by at least 30 mm.

In one embodiment, the projection extends from the upper surface of the seating by at least 25 mm.

In one embodiment, the seat defines an annular plate. In other embodiments, the seat defines an inverted bowl or a truncated cone, further promoting product to lie at rest in an attitude away from the axis of discharge.

According to a second aspect of the invention, there is provided a method of discharging a flexible bulk container, the method sequentially comprising: providing a discharge device having a seat with an outlet region configured for receiving an outlet channel of a flexible bulk container; positioning a flexible bulk container on the seat with an outlet channel of the container extending through the outlet region of the seat, and vibrating said seat to promote flow of product from the bulk container wherein the seat is configured for the base of the container to overhang a periphery of the seat when seated thereon.

In one embodiment, the discharge device comprises a displacement member configured for movement away from the seat for agitation of the container, and the method comprises the step of moving said displacement upwards after vibration of the seat.

In one embodiment, the method is carried out using the discharge assembly according to the first aspect.

According to a third aspect of the invention, there is provided a discharge apparatus comprising a flexible bulk container having a base and an outlet channel extending from the base and having an outlet at one end through which product is to be dispensed, a seat onto which the base of the bulk container is seated for a discharge operation, the seat including an outlet region through which the outlet channel of the bulk container extends when seated thereon, and a vibration unit for selectively vibrating the seat, wherein the seat includes a projection proximal yet spaced from said outlet region, which extends from an upper surface of the seat.

In one embodiment, the seat is configured for the base of the container to overhang a periphery of the seat when seated thereon.

In one embodiment, the seat has a flat upper surface (i.e. it is a flat plate).

In one embodiment, the seat is curved or angled downwardly from the outlet region towards an outer edge of the seat.

In one embodiment, the seat includes a central aperture, which defines the outlet region.

In one embodiment, the seat is circular in plan view.

In one embodiment, the discharge device comprises a displacement member configured for movement away from the seat for agitation of the container.

In one embodiment, the displacement member is concentric with the seat and has in internal diameter greater than the outer diameter of the seat.

In one embodiment, a flexible wall extends between the displacement member and the seat.

In one embodiment, the wall extends between an inner edge of the displacement member and the periphery of the outlet region in the seat.

In one embodiment, the displacement member is configured to move from a retracted position to an extended position in which the wall defines a cone-shaped passageway for directing a flow of product from the container.

In one embodiment, an inner edge of the displacement member is spaced from the outer edge of the seat, to create a void into which the base of the container sags when the displacement member is in the retracted position.

In one embodiment, the spacing between the displacement member and the seat in the retracted position is at least in the region of 100 mm (e.g. in the region 100 mm to 300 mm).

In one embodiment, the discharge assembly comprises one or more actuators (e.g. hydraulic, pneumatic, or mechanical actuators) for movement of the displacement member relative to the seat.

In one embodiment, the discharge assembly comprises a detector for detecting product flow rate, an actuator for selectively raising the displacement member relative to the seat, and a controller configured to receive a signal from the detector and send a signal to the actuator indicating when the displacement member should be raised.

In one embodiment, the discharge assembly comprises a frame from which the container is suspended in order to sit on the seat.

In one embodiment, the frame comprises two parts: an upper part for connection of the upper end of a bulk container and a lower part including the seat.

In one embodiment, the upper part is movable relative to the lower part, for lifting the upper end of the bulk container away from the seat.

In one embodiment, the projection is spaced from the outlet by at least 30 mm.

In one embodiment, the projection extends from the upper surface of the seating by at least 25 mm.

In one embodiment, the seat defines an annular plate. In other embodiments, the seat defines an inverted bowl or a truncated cone, further promoting product to lie at rest in an attitude away from the axis of discharge.

According to a fourth aspect of the invention, there is provided a discharge apparatus for use with a bulk container of the kind having an outlet through which product is to be dispensed, the discharge apparatus comprising an inlet end, an outlet end, and a wall extending between said inlet end and said outlet end, wherein said inlet end is configured for receiving the lower end of a bulk container, said outlet end is configured for directing a flow of product from a bulk container received in the inlet end, wherein the apparatus is configured to allow relative movement between said inlet end and said outlet end to alter the distance between said inlet end and said outlet end, further wherein the wall between said inlet end and said outlet end is of flexible construction, to accommodate said relative movement, still further wherein the outlet end comprises a support plate for supporting the lower end of a bulk container and having an aperture which defines an outlet region through which the outlet of a bulk container can extend when supported on the support plate, wherein the support plate includes a projection proximal yet spaced from said outlet region, which extends from an upper surface of the support plate.

In one embodiment, the support plate is configured for the outlet end of the container to overhang a periphery of the support plate when seated thereon.

In one embodiment, the support plate has a flat upper surface (i.e. it is a flat plate).

In one embodiment, the support plate is curved or angled downwardly from the outlet region towards an outer edge of the support plate.

In one embodiment, the support plate is circular in plan view.

In one embodiment, the discharge apparatus comprises a displacement member configured for movement away from the support plate for agitation of the container.

In one embodiment, the displacement member is concentric with the support plate and has in internal diameter greater than the outer diameter of the support plate.

In one embodiment, the wall extends between an inner edge of the displacement member and the periphery of the outlet region in the support plate.

In one embodiment, the displacement member is configured to move from a retracted position to an extended position in which the wall defines a cone-shaped passageway for directing a flow of product from the container.

In one embodiment, an inner edge of the displacement member is spaced from the outer edge of the support plate, to create a void into which the base of the container sags when the displacement member is in the retracted position.

In one embodiment, the spacing between the displacement member and the support plate in the retracted position is at least in the region of 100 mm (e.g. in the region 100 mm to 300 mm).

In one embodiment, the discharge assembly comprises one or more actuators (e.g. hydraulic, pneumatic, or mechanical actuators) for movement of the displacement member relative to the support plate.

In one embodiment, the discharge assembly comprises a detector for detecting product flow rate, an actuator for selectively raising the displacement member relative to the support plate, and a controller configured to receive a signal from the detector and send a signal to the actuator indicating when the displacement member should be raised.

In one embodiment, the discharge assembly comprises a frame from which the container is suspended in order to sit on the support plate.

In one embodiment, the frame comprises two parts: an upper part for connection of the inlet end of a bulk container and a lower part including the support plate.

In one embodiment, the upper part is movable relative to the lower part, for lifting the upper end of the bulk container away from the support plate.

In one embodiment, the projection is spaced from the outlet by at least 30 mm.

In one embodiment, the projection extends from the upper surface of the seating by at least 25 mm.

In one embodiment, the support plate defines an annular plate. In other embodiments, the support plate defines an inverted bowl or a truncated cone, further promoting product to lie at rest in an attitude away from the axis of discharge.

According to another aspect of the invention, there is provided a discharge assembly comprising:

- a flexible bulk container having a base and an outlet channel extending from the base and having an outlet at one end through which product is to be dispensed,
- a seat onto which the base of the container is seated for a discharge operation, the seat including an outlet region through which the outlet channel of the bulk container extends when seated thereon, and
- a vibration unit for selectively vibrating the seat;
- wherein the upper surface of the seat is angled or curves downwards away from the periphery of the outlet region, so that product not immediately aligned with the outlet region will have a tendency to lean away from the axis of discharge when the container is seated thereon and the vibration unit is inoperative.

Again, the invention is primarily advantageous for the discharge of loose, powdered or granular product, such as plastics, minerals, chemicals, agricultural products or foodstuffs.

In exemplary embodiments, the seat defines a bowl or truncated cone.

When a full or partially full container is seated on the seat with the outlet sealed against discharge, the configuration of the seat means that there is a tendency for some product within the container to 'lean' away from the outlet region of the seat (i.e. in the direction of the overhang). It has been found that, once product is allowed to flow through the outlet of the container, product immediately above the outlet region will fall through the outlet. However, some material will remain stacked around the periphery of the outlet region. More particularly, the configuration of the seat has been found to produce a clear central region within the container (in effect, as if a central column of the product has been removed). If the vibration unit is then activated, the seat is vibrated and this has been found to cause material from the top of the 'stacked' product to begin to fall down through the void created by the initial discharge. This assembly and process has been found to facilitate a more controlled method of discharge from flexible bulk containers, in particular of the FIBC-type. Importantly, upon deactivation of the vibration unit, product remaining within the container tends to remain at rest within the container, again with a tendency to lean away from the axis of discharge (with the outlet channel free of product). This means that the outlet channel of the container can be tied off easily, making it easy to return a partially discharged container to storage.

In exemplary embodiments, the seat is configured so that the base of the container overhangs a periphery of the seat when seated thereon, further promoting product to lie at rest in an attitude away from the axis of discharge.

According to a further aspect of the invention, there is provided a discharge system comprising:

- a flexible bulk container having a base and an outlet channel extending from the base through which product is to be dispensed; and a discharge device for discharging product from the container;
- wherein the discharge device comprises:
- a seat onto which the container is to be loaded, the seat including an outlet region through which the outlet channel of the container extends, in use;
- a vibration unit for selectively vibrating the seat; and
- a displacement member concentric with the seat, wherein the lower end of the container is located within a boundary defined by the displacement member in use, and wherein the displacement member is movable from a retracted state to an extended state for agitating the container;
- wherein the seat defines and axis of discharge, and is configured for promoting product within the container to move radially away from the axis of discharge.

In exemplary embodiments, the seat has an upper surface which is angled or curves downwards away from the periphery of the outlet region, so that product not immediately aligned with the outlet region will have a tendency to lean away from the axis of discharge when the container is seated thereon and the vibration unit is inoperative.

In exemplary embodiments, the seat is configured so that the base of the container overhangs a periphery of the seat when seated thereon, e.g. the area of the base of the container is effectively greater than the area defined by the periphery of the seat.

The invention is primarily advantageous for the discharge of loose, powdered or granular product, such as plastics, minerals, chemicals, agricultural products or foodstuffs.

DESCRIPTION OF DRAWINGS

Other aspects and features of the invention will be apparent from the claims and the following description of embodiments, made by way of example, with reference to the accompanying drawings, of which:

DETAILED DESCRIPTION

Referring firstly to FIGS. 3 to 7, a discharge assembly is indicated generally at 20.

Figure 1:
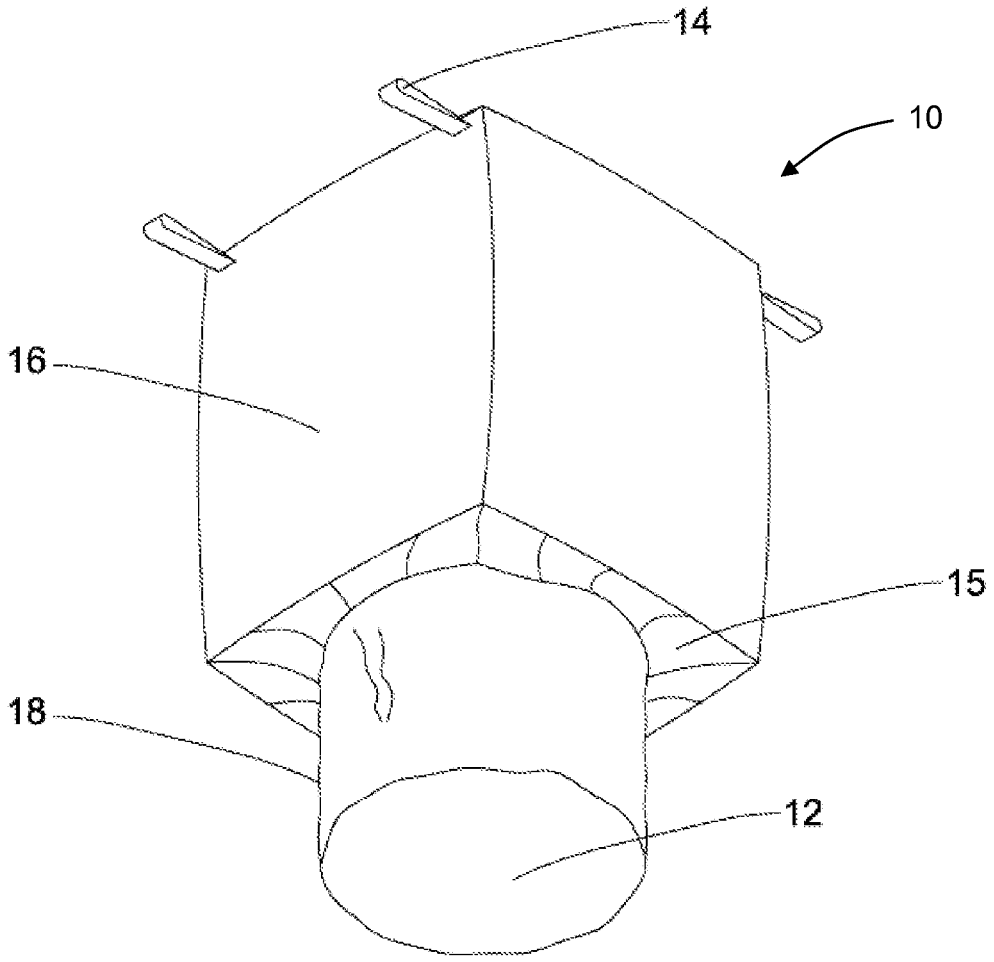
FIGS. 1 and 2 show a perspective view of an FIBC known in the art.
Figure 2:
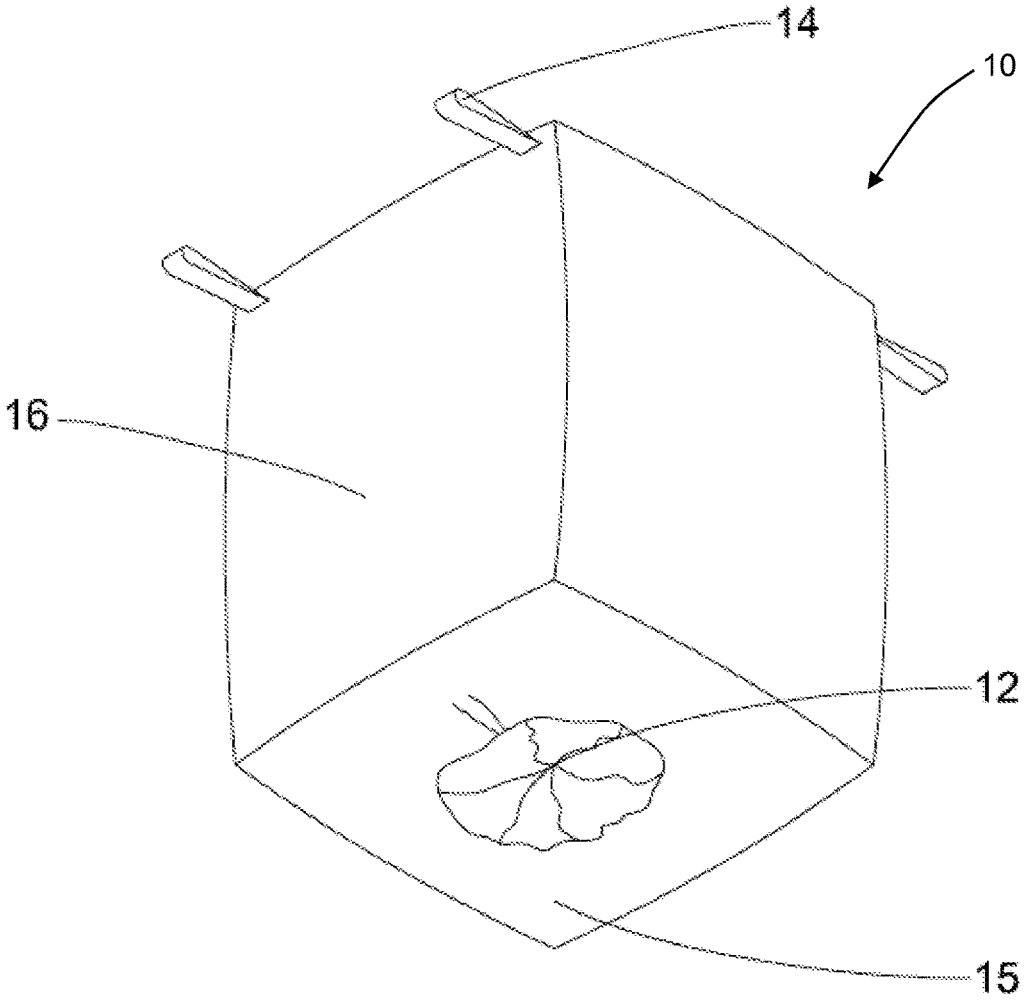

A bulk container (in particular, a flexible intermediate bulk container or 'FIBC' 10 of the kind shown in FIGS. 1 and 2) is supported for a discharge operation on a frame. The frame has four legs 23 at corner regions of the frame, and cross bars 25*a*, 25*b* extending between the legs 23 at the upper and lower ends of the frame. Although not visible in the drawings, the frame is rectangular in plan view.

In this embodiment, the frame is formed in two parts: an upper or suspension part 22 and a lower or discharge part 24. The upper part 22 seats on the lower part at connectors 21. The connectors 21 of the present embodiment are substantially aligned, but connectors 21 may be offset from one another. The FIBC is connected to the upper part 22 of the frame via connectors 26 provided on the cross bar 25*a* of the upper part 22 of the frame.

The assembly 20 includes a support plate 32 onto which the FIBC 10 is seated when the upper part 22 of the frame is connected to the lower part 24. The support plate 32 has a central aperture or outlet region through which the outlet channel of the FIBC 10 extends for a dispensing operation.

Importantly, the support plate 32 is configured so that the base 15 of the FIBC 10 overhangs a periphery of the plate 32 when seated thereon. Put another way, the area of the base 15 is effectively greater than the area defined by the periphery of the support plate 32.

In exemplary embodiments, the support plate 32 defines an annulus in plan view, with an outer diameter smaller than the base 15 of the FIBC 10. In alternative embodiments, the support plate may be of any suitable shape e.g. square or an alternative polygon, dimensioned to create an 'overhang' when the FIBC 10 is seated thereon.

Figure 11:
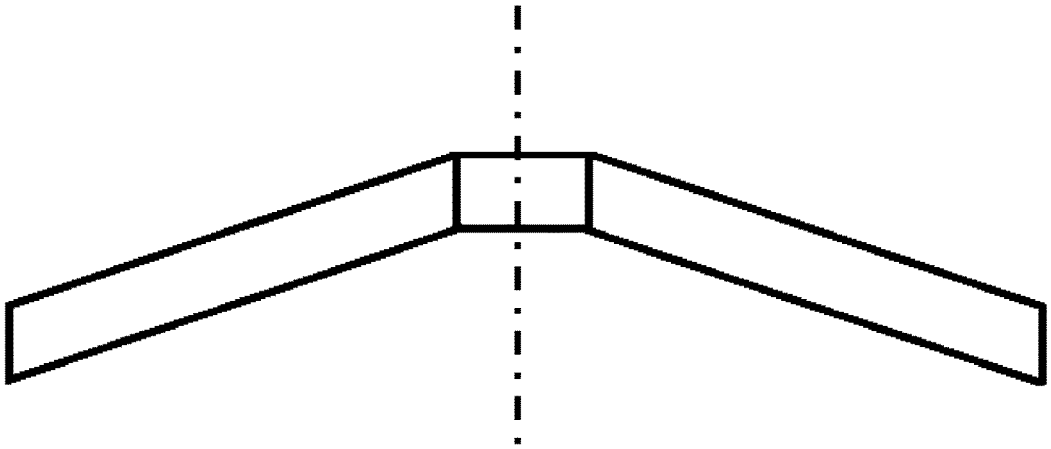
FIGS. 11 and 12 show different configurations of support plate.
Figure 12:
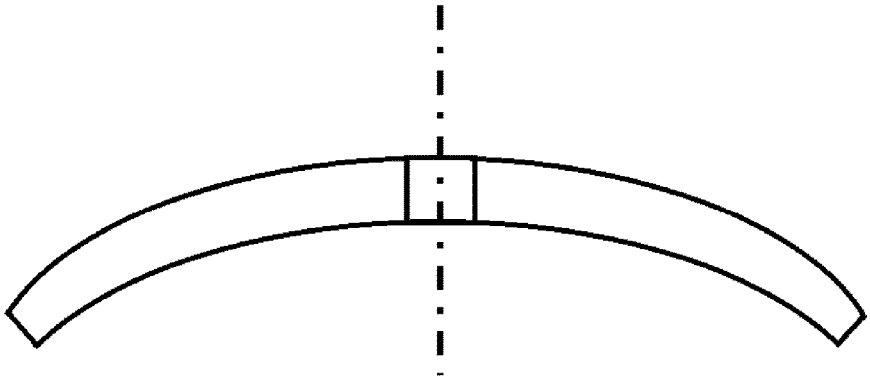

In the present embodiment, the support plate 32 is substantially flat. However, in other embodiments, the support plate takes the form of a truncated cone or an inverted bowl. Examples are shown in FIGS. 11 and 12, respectively. In other words, the support plate 32 may define a seat onto which the FIBC may be loaded, the seat having an upper surface which is angled or curves downwards away from the periphery of the outlet region, so that product not immediately aligned with the outlet region will have a tendency to lean away from the axis of discharge D-D when the container is seated thereon. In such embodiments, the extent of the curve or angle will be such that access to the outlet channel of the FIBC 10 (when extending through the outlet region) is not impeded.

A vibration unit 52 is mounted on an underside of the support plate 32 and is operable to vibrate the support plate 32.

The discharge assembly 20 includes a transfer section or conduit 54 arranged between the support plate 32 and a lower region of the discharge assembly 20, for transferring product discharged from the bulk container 10. In use, the outlet channel 18 of the container is arranged in communication with the conduit 54. In this embodiment, a quick release clamp 64 is provided at an inlet to the conduit 54 for selectively clamping the outlet channel 18 of the FIBC. The conduit may include or be arranged in communication with a valve device for controlling product discharge.

In the illustrated embodiment, the assembly 10 forms part of an industrial process, e.g. so that the conduit 54 is used for discharging product directly into a process. However, in other embodiments, the assembly can be used for charging other containers with product from the FIBC.

The support plate 32 forms part of a discharge device 40. The discharge device 40 is of variable configuration. More particularly, the discharge device 40 has first part 30 intended to move relative to a second part 32, for assisting product discharge from the FIBC 10. The first part 30 may therefore be referred to as a displacement member, whereas the support plate is the second part of the discharge device 40, and is fixed.

The displacement member 30 is concentric with support plate 32 and defines an annulus (e.g. of circular or any polygonal shape) having an inner diameter greater than the outer diameter of the support plate 32.

A flexible wall 34 (seen most clearly in FIGS. 6 and 7) extends between the displacement member 30 and the support plate 32. More particularly, the wall 34 extends between the inner edge of the displacement member 30 and the periphery of the outlet region in the support plate 32.

Figure 3:
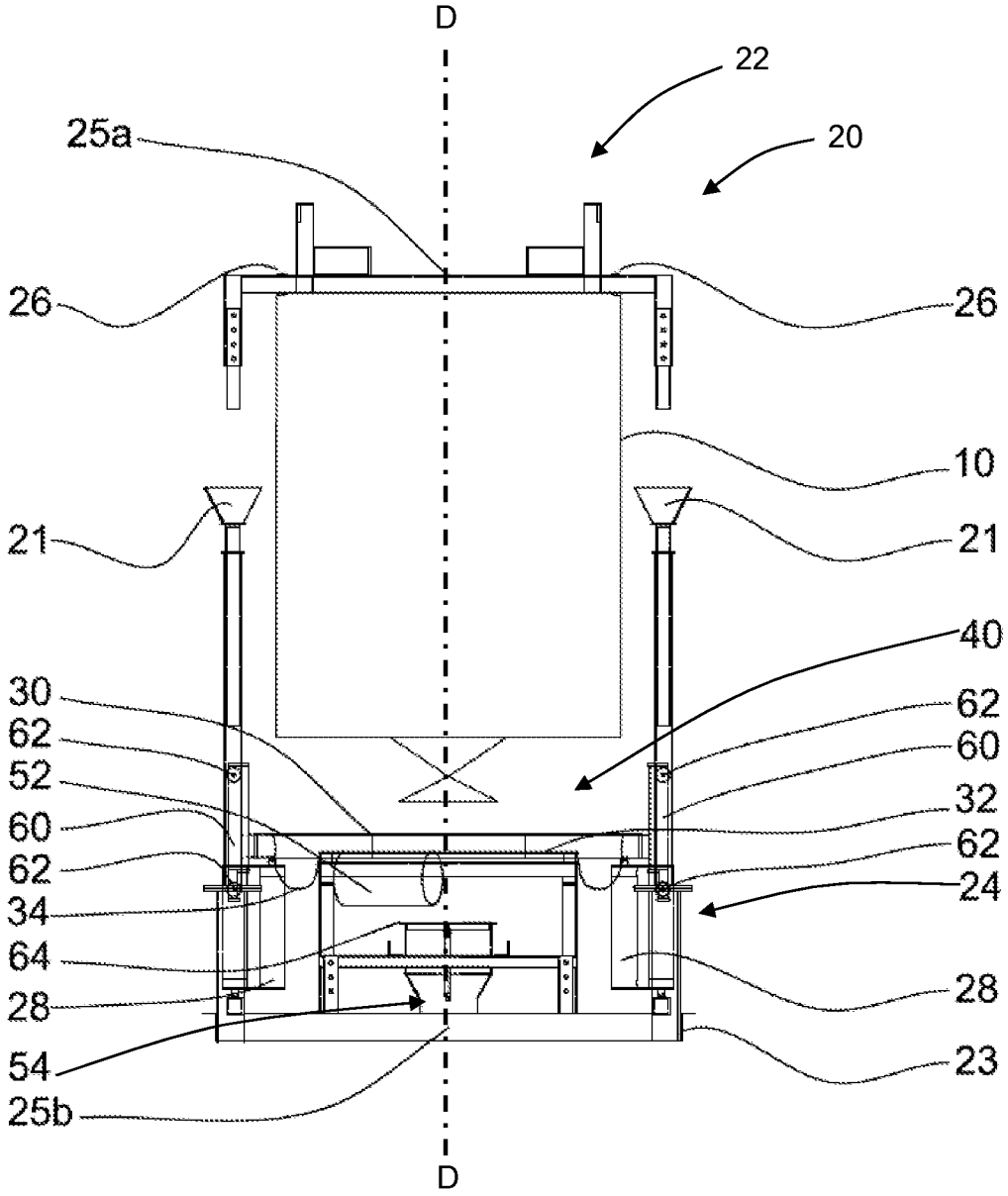
FIGS. 3 to 7 show a partially sectioned front view of a discharge assembly at various stages of operation.

The displacement member 30 has an internal diameter greater than the diameter of the base 15 of the FIBC, so that the FIBC is located within a boundary defined by the displacement member 30, when the displacement member is in a retracted position (e.g. as shown in FIG. 3). As such, the displacement member may also be referred to as the inlet of the discharge device, whereas the support plate 32 defines the outlet of the discharge device (since the outlet channel of the FIBC extends through the outlet region of the support plate 32, for discharge operations).

In the retracted position, the displacement member 30 is proximal the support plate 32 (e.g. in general alignment along a horizontal plane). However, the displacement member 30 is arranged to move upwards, away from the support plate 32, to an extended position. In the extended position, the wall 34 defines a cone-shaped passageway 35 for directing a flow of product from the FIBC 10.

As can be seen from FIG. 3, the inner edge of the displacement member 30 is spaced from the outer edge of the support plate 32, e.g. by at least 10 centimeters in exemplary embodiments. Hence, the wall material sags between the displacement member 30 and the support plate 32 in the retracted position.

Cylinders 28, in the present embodiment pneumatic cylinders (or could alternatively be hydraulic or screw jacks), are used to lift the first part 30 of the discharge device 40 away from the support plate 32. The cylinders 28 are positioned substantially centrally between the legs 23 side to side (or could be front and rear) of the discharge assembly 20, and extend between the cross bar 25*b* of the lower part 24 of the frame and the inlet part 30 of the discharge device 40. In the present embodiment, the cylinders 28 include two piston rods which each move in opposition in a vertical direction, in order to raise the inlet part 30 of the discharge device 40 (i.e. the cylinders are double acting).

In this embodiment, the upper frame 22 is configured to be movable in an upward direction, for lifting an upper end of the FIBC 10 during or after a discharge operation. In this embodiment this is achieved using cylinders 60, in the present embodiment the cylinders 60 are pneumatic cylinders (but could be hydraulic cylinders or screw jacks). Each cylinder 60 includes two piston rods that move vertically in opposing directions (i.e. the cylinders are double acting). Guide wheels 62 are provided to travel in contact with the inside of the leg 23 to ensure the cylinders 60 stay nominally in line, and avoid jamming that might otherwise occur when lifting a variable or out of balance load.

Figure 8:
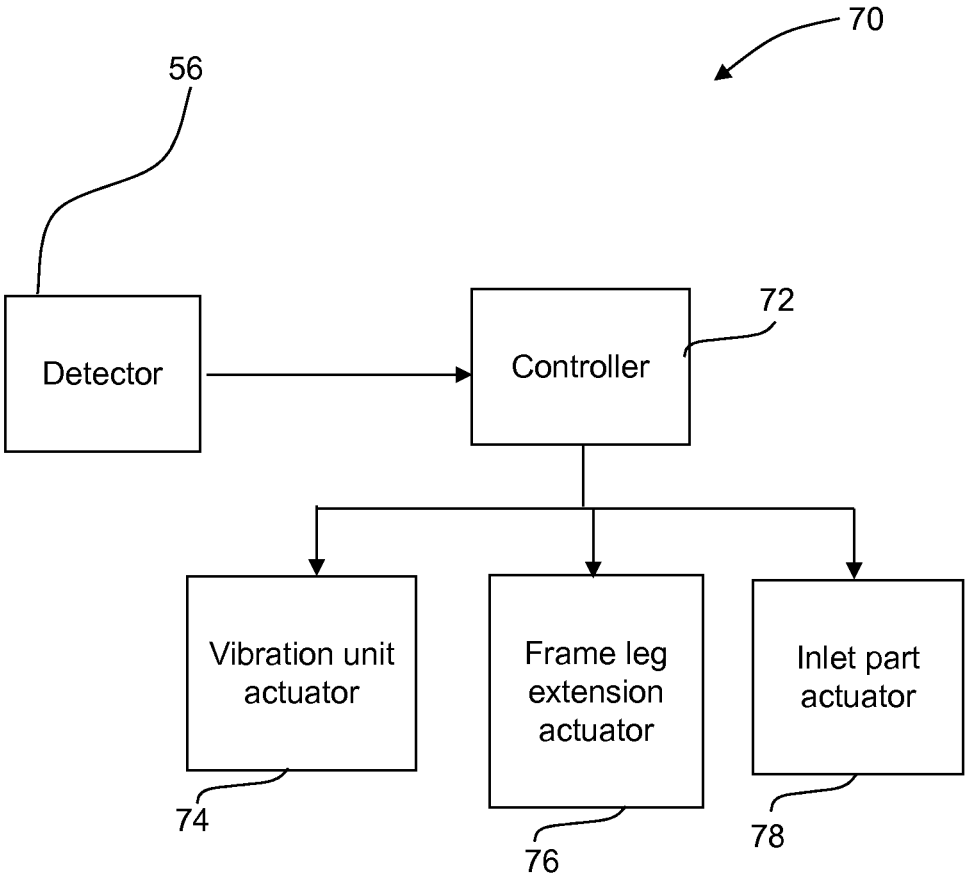
FIG. 8 shows a control system of the discharge assembly of FIGS. 3 to 7.

Referring to FIG. 8, a control system 70 is provided for controlling operation of the vibration unit 52 and cylinders 28 and 60. In alternative embodiments, the vibration unit and/or cylinders may be manually operated.

The control system 70 includes a detector 56 for detecting the flow rate of product from the FIBC 10. In the present embodiment the detector 56 includes load sensors positioned to measure the load of the FIBC 10, i.e. the flow rate is indirectly measured. In alternative embodiments the detector may include any other suitable type of sensors e.g. light sensors and be positioned in any suitable region, e.g. in conduit 54.

A controller 72 is provided for controlling the actuation of the vibration unit 52 and/or cylinders 28 and/or 60. The controller may include a central processing unit (CPU). The detector 56 is configured to send a signal to the controller 72 to indicate the flow rate of product from the FIBC 10. The controller 72 is configured to receive the signal from the detector 56 and compare the measured load with a pre-determined minimum load for a given stage of discharge. Alternatively, the controller may calculate the flow rate based on the rate of change of load of the FIBC 10, and compare the calculated flow rate with a pre-determined minimum flow rate.

The controller is configured to send a signal to a vibration unit actuator 74, frame extension actuator 76 and/or an inlet part actuator 78 according to a preset protocol. The vibration unit actuator 74 may include a switch to selectively apply electrical current to the vibration unit. The leg extension actuator and/or the inlet part actuator may comprise a pneumatic valve for controlling the flow of compressed air to the cylinders 28 and/or 60.

The preset protocol will become apparent from the following description of an exemplary method of operating the discharge assembly.

Referring to FIG. 3, firstly a full or substantially full FIBC 10 (having its outlet conduit in a tied state to prevent discharge) is connected to the upper part 22 of the frame via the connectors 26. Typically, a forklift or hoist will be used to position the upper part 22 of the frame over an upper end of the FIBC 10. The upper part 22 of the frame is then positioned over the lower part 24 of the frame, and connected thereto via connectors 21.

Typically, the FIBC will contain a loose, powdered or granular product, such as plastics, minerals, chemicals, agricultural products or foodstuffs.

Figure 4:
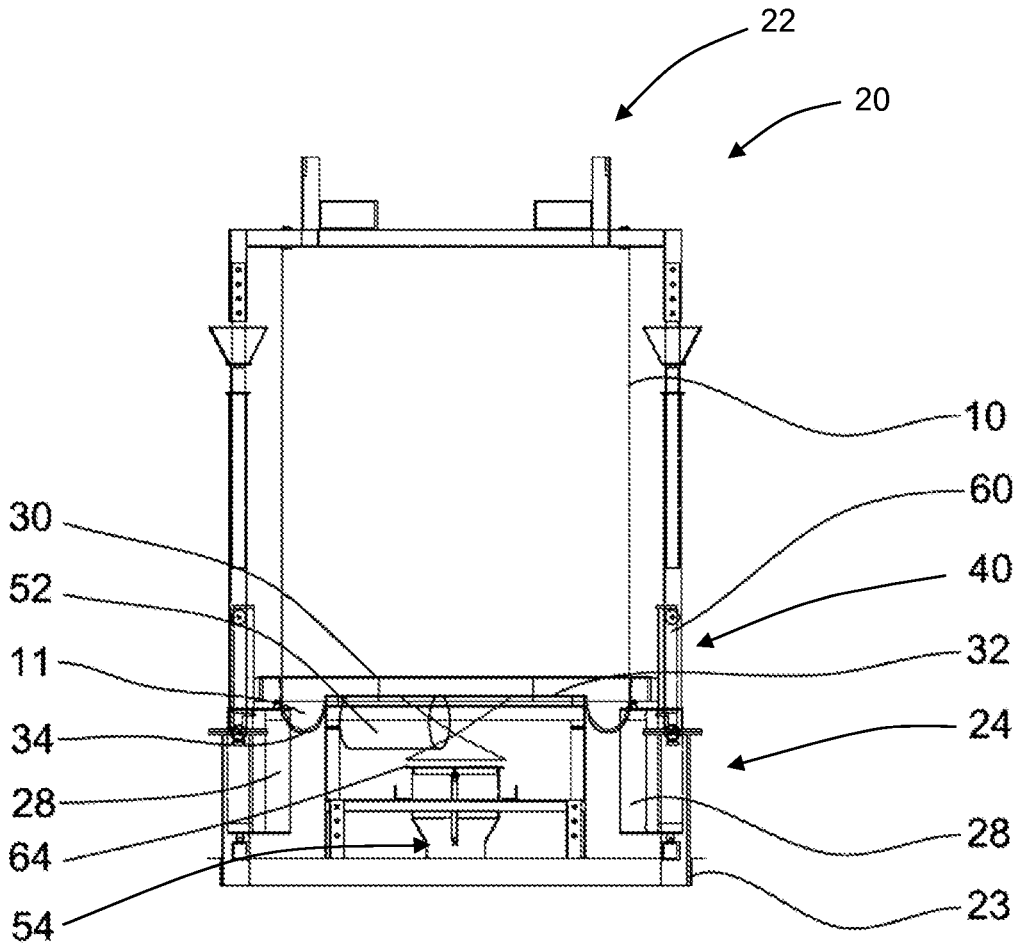

Referring to FIG. 4, when the upper part 22 is connected to the lower part 24 of the frame, a portion of the base 15 of the FIBC 10 is seated on the support plate 32, with the outer diameter of the FIBC 10 located within the inlet 30 of the discharge device and the outlet channel 18 of the FIBC 10 positioned through the outlet region of the support plate 32.

As can be seen in FIG. 4, the area of the base of the container is greater than the area defined by the periphery of the plate 32. Hence, when the full or partially full container is seated on the plate 32 with the outlet sealed against discharge, product at the sides of the container forms an overhang 11 with respect to the periphery of the plate 32 (e.g. between the plate 32 and the inner diameter of the displacement member 32). This creates a tendency for some product within the container to 'lean' away from the outlet region of the plate 32 (i.e. in the direction of the overhang 11).

Figure 5:
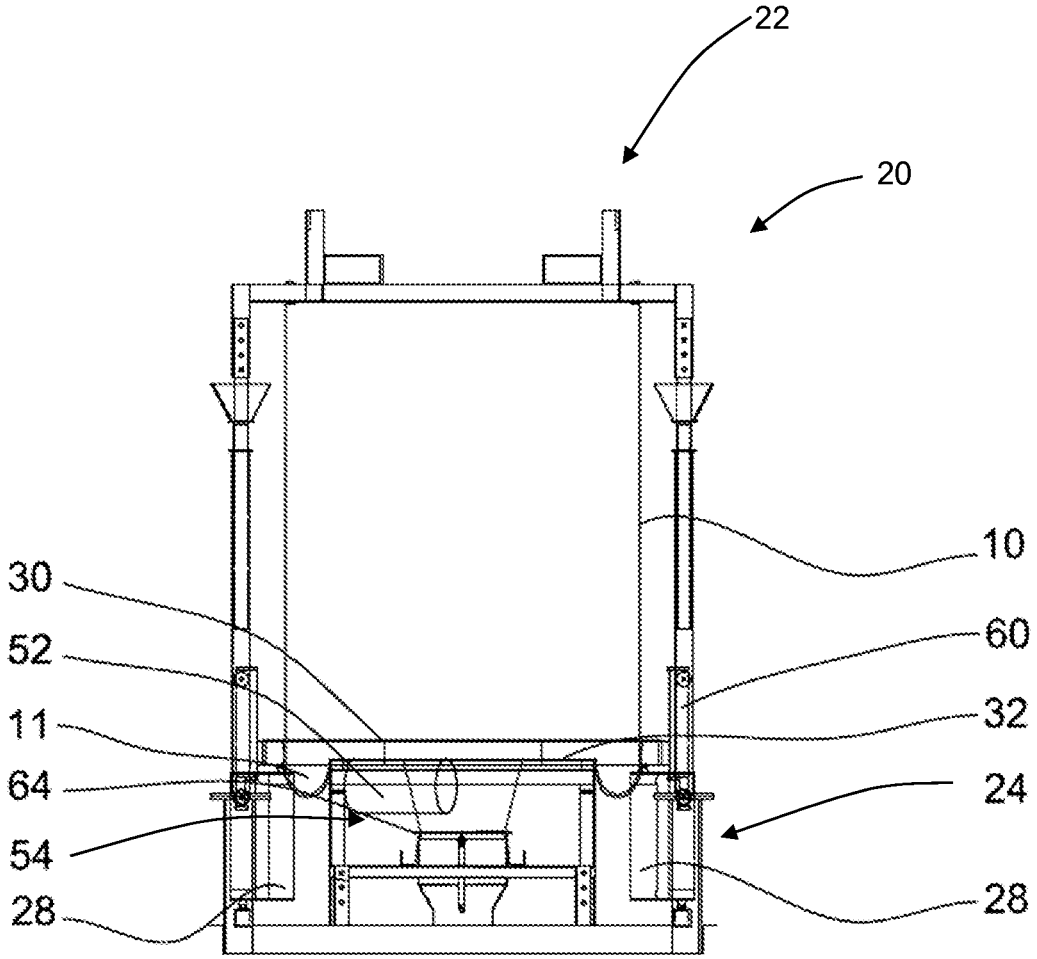

The clamp 64 is then operated to sealingly connect the outlet channel 18 in communication with the transfer conduit 54 (e.g. as shown in FIG. 5).

Figure 9:
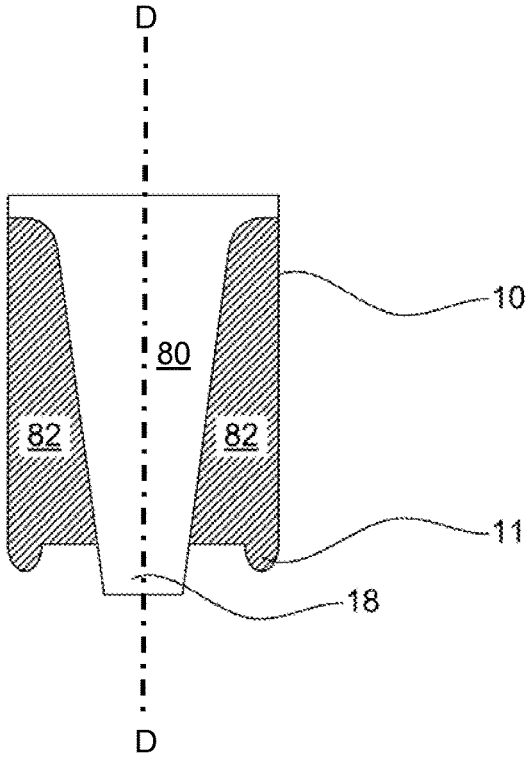
FIGS. 9 and 10 show different stages of product flow from an FIBC of the discharge assembly of FIGS. 3 to 7.

It has been found that, once product is allowed to flow through the outlet of the FIBC (i.e. when the channel 18 is untied), product immediately above the outlet region will fall through the outlet of the FIBC. However, some material will remain stacked within the container, i.e. as an annulus 82 above the periphery of the outlet region (as schematically shown in FIG. 9). More particularly, promotion of the overhang 11 has been found to produce a clear central region 80 within the FIBC (in effect, as if a central column of the product has been removed), e.g. as shown schematically in FIG. 9). If the vibration unit is then activated, the plate 32 is vibrated, and this has been found to cause material from the top of the 'stacked' product 82 to begin to fall down through the central void 80 created by the initial discharge, e.g. as shown schematically in FIG. 10. This has been found to facilitate a more controlled method of discharge from the FIBC.

Figure 10:
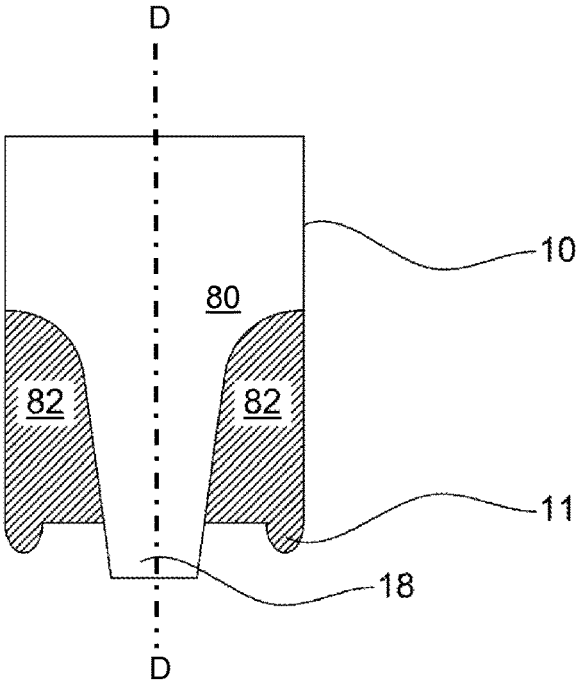

Importantly, when the vibration unit is inoperative, e.g. at the moment shown in FIG. 9 or FIG. 10, product 82 remaining within the container tends to remain at rest, again with a tendency to lean away from the axis of discharge, and with the outlet channel 18 free of product. This means that the outlet channel 18 can be tied off easily, making it easy to return a partially discharged container 10 to storage.

Operation of the vibration unit is controlled by controller 72. For example, when the flow rate of product (indicated by detector 56) is below a pre-determined minimum level, the controller 72 sends a signal to the vibration unit actuator 74 to actuate vibration of the vibration unit 52 (e.g. for a predetermined period of time, or until a predetermined weight of product has been dispensed, or until flow rate is below a predetermined level).

After one or more periods of vibration, the controller 72 can be used to activate the discharge device, i.e. to cause upward movement of the inlet part 30 away from the support plate 32.

Figure 6:
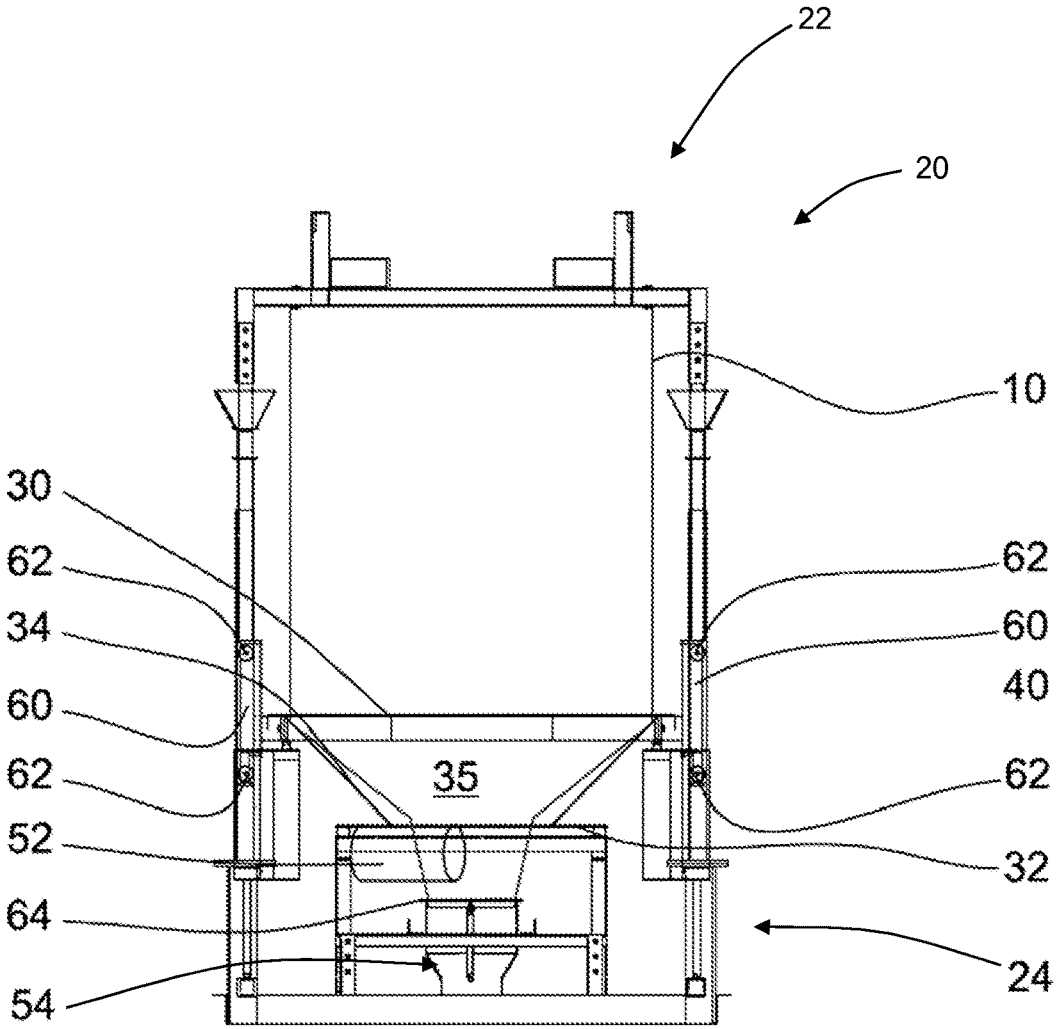

FIG. 6 shows the assembly 20 after movement of the inlet part 30 to an intermediate extended position. This movement causes the discharge device to agitate the FIBC, and urge at least some of the overhanging product towards the centre of the FIBC, to further aid discharge. The wall 34, whilst not fully extended, helps to direct a flow of material through the outlet region of the support plate and into the outlet channel 18.

The vibration unit may then be activated for one or more periods to promote additional flow from the container.

Figure 7:
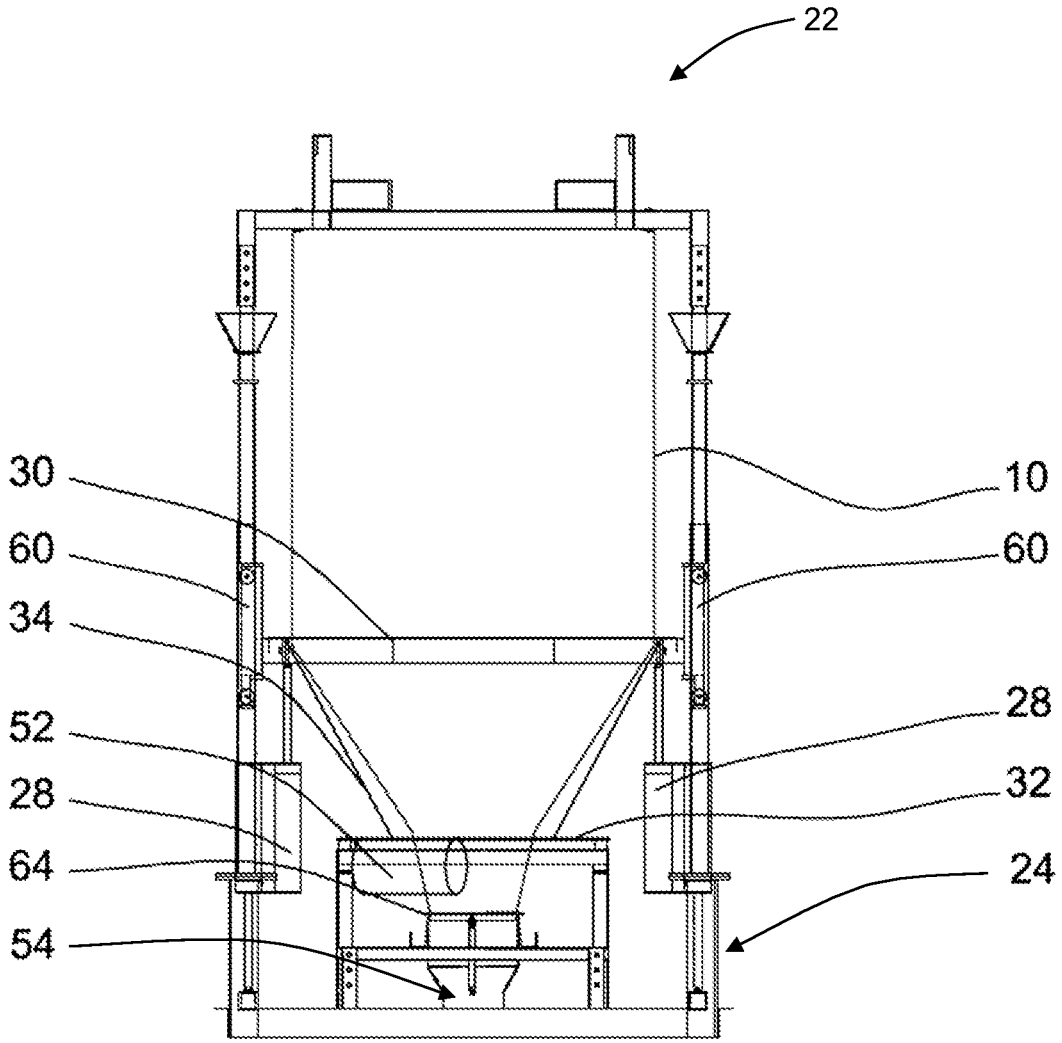

FIG. 7 shows the discharge device in a fully extended state assembly, and with the legs 23 extended, in order to raise the upper part 22 of the frame relative to the lower part 24 of the frame and promote a final discharge of product from the container. Again, the vibration unit may be activated for one or more periods to promote final discharge.

After final discharge, the outlet channel 18 is retied, the clamp 64 is released, and the upper part 22 of the frame can be lifted from the lower part of the frame 24. The substantially empty FIBC 10 is then removed from the upper part 22 of the frame.

In embodiments where the upper surface of the support plate 32 is angled or curves downwards away from the outlet region, the requirement for an 'overhang' may be reduced or obviated. As such, there may be little or no spacing between the inner edge of the inlet part 30 and the outer edge of the outlet part of the discharge device.

Discharge assemblies of the type described herein enable improved discharge efficiency. This is particularly important when the product contained in the FIBC is expensive, and/or when operative time needs to be minimised (e.g. with little or no manual intervention).

Although the invention has been described above with reference to one or more exemplary embodiments, it will be appreciated that various changes or modifications may be made without departing from the scope of the invention as defined in the appended claims.

For example, the FIBC may not be suspended from a frame, but may instead be suspended from a crane or other object, wherein the lower end of the FIBC is supported on the discharge device in such a way as to enable the discharge device to move from a collapsed state to an extended state during the discharge of product from the FIBC, with the upper end of the discharge device driven or otherwise urged upwards against the FIBC, e.g. under the influence of biasing elements.

Movement of the inlet part 30, upper part 22 of the frame, or operation of the vibration unit may be manually operated, e.g. by pressing one or more buttons or operating a switch.

In an exemplary embodiment, the pneumatic cylinder 28, may be arranged to pull against the load of the FIBC 10 to pull the inlet part 30 of the discharge device 40 upwards, rather than being arranged to push the inlet part upwards.

In alternative embodiments, the outer perimeter of the inlet part 30 and/or support plate 32 may be a different shape to the aperture defined by the annulus. For example, the outer perimeter of the inlet part 30 and/or outlet part 32 may be square or rectangular and the aperture may be circular.

In further alternative embodiments, an additional vibration unit may be provided on the inlet part 30. For example, the inlet may be vibrated when the inlet is lifted, and/or after the inlet has been lifted, to cause the wall of the cone to vibrate and promote product flow. In yet a further alternative embodiment, a vibration unit may be provided for agitating product within the conduit 54.

When the discharge assembly 20 is used on a production line, it may be desirable to have multiple discharge assemblies in storage, e.g. with an FIBC 10 attached to an associated frame and discharge device 40. When a replacement container 10 is required, the whole discharge assembly 20 can be moved to a discharge site. For example, the whole discharge assembly 20 may be fork lifted to and located at the required discharge point. Alternatively, the whole discharge assembly 20 may be brought on stream automatically.

The raising of the inlet part 30 relative to the support plate 32 in the present embodiment is done using cylinders 28, but in an alternative embodiment a biasing element may be connected to each leg 23 of the frame. The biasing elements 28 may be roller springs arranged to pull on the inlet part 30 of the discharge device 40, for urging the inlet part 30 in an upward direction.

The support plate may be of solid construction, or may be defined by material having a meshed or matrix configuration.

The concepts described above are equally applicable to fixed discharge stations, including for smaller discharge applications from a container of any size and product (e.g. using bulk containers smaller than conventional FIBCs). For example, the above described embodiments can be scaled down or modified for use as a small fixed station, to replace existing systems such as the "Pack Off Weigh Module", which will be familiar to a person skilled in the art.

In an alternative embodiment, the discharge assembly may be used as a 'fixed hopper' type discharge station. In such embodiments, a container wall may be provided. The container wall may define a barrier around the sides of the FIBC, providing additional strength and security. The container wall may be designed to contact the sides of the FIBC when the bulk container is at full product capacity or fully inflated with air or any suitable gas such as nitrogen, such that the container wall provides a support for the walls of the FIBC.

The container wall may be a flexible material that can be collapsed, e.g. during movement of the discharge device or alternatively can be lifted with the outlet and inlet part of the discharge device minimising wrinkling. In embodiments where the bulk container is a flexible intermediate bulk container (FIBC), the container wall may be made from a similar flexible material as the FIBC (e.g. conventional FIBC fabric material). In 'fixed hopper' applications, the discharge assemblies described herein avoid the need for hopper clean down in most circumstances, reducing the time for a product change and significantly reducing the risk of cross contamination.

In a further embodiment, the discharge device may be a site fixed surge hopper or small silo. In such applications the above described embodiments can be used to improve the discharge capabilities, particularly when difficult powders are handled or where improved discharge performance is a pre-requisite.

Figure 13:
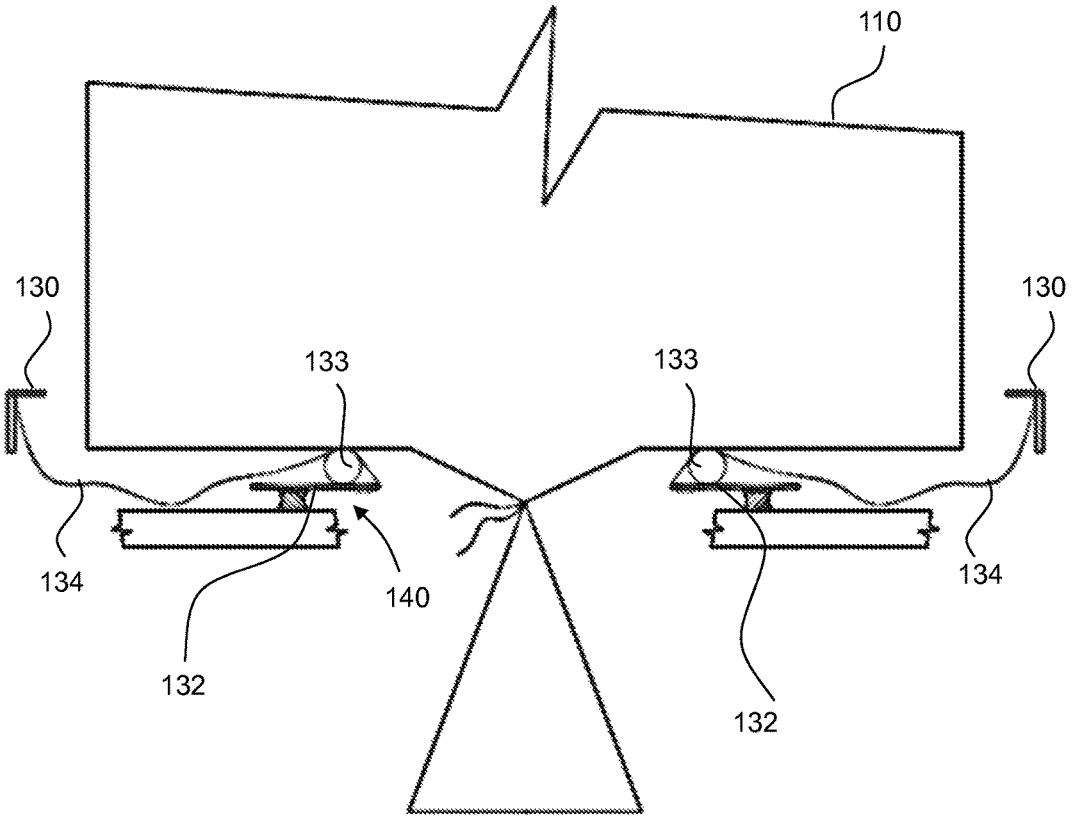
FIG. 13 is a schematic view of part of a discharge assembly having a modified support plate.

FIG. 13 relates to a modified support plate 132, which includes a projection 133 proximal yet spaced from the outlet region of the support plate 132, e.g. by a spacing in the region of 30 mm to 200 mm. The projection 133 is generally annular in form and is arranged to be concentric with the through axis of the outlet region. As can be seen, the flexible wall 134 of the discharge device 140 extends from the rim of the outlet region, over the projection 133, and terminates at the displacement member 130 of the discharge device 140.

In use, the FIBC 110 (shown with the outlet tied off in FIG. 13) is placed on the support plate 132, inside the region defined by the flexible wall 134 of the discharge device 140. Accordingly, a portion of the underside of the FIBC 110, annular to the outlet of the FIBC 110, will be at rest on the projection 133, prior to a dispensing operation.

A major advantage of the projection is that it will serve to create fault lines in the product stored at the outlet end of the FIBC 110. This has been found to promote a diversion of pressure in the bag away from the outlet, enabling product arranged immediately above the outlet to flow more freely during the initial stages of discharge, e.g. until the product reaches its natural angle of repose. This may minimise or obviate the need for vibrational assistance, in some cases (e.g. dependent on the nature of the product to be dispensed and its relative compacted state prior to discharge). The modified support plate 132 may therefore be more economical and user friendly. In the case of a cohesive/dense product with poor flow characteristics, the projection 133 may help to promote the creation of such fault lines upon the immediate addition of vibration during the initial stages of discharge, whereupon the need for additional vibrational assistance may be minimised or obviated, again making for a more economical and user-friendly discharge apparatus.

The configuration and spacing of the projection 133 may be modified dependent upon the intended use of the discharge apparatus (e.g. dependent on the nature of the FIBC and/or the flow characteristics of the product to be dispensed). It is expected that a minimum height of the projection 133 (i.e. from the upper surface of the support plate 132) will be in the region of 25 mm, perhaps with a maximum height in the region of 150 mm.

In the embodiment of FIG. 13, the projection 133 is formed from a rigid tube of circular cross-section, and defines a circular ring concentric with the outlet of the support plate 132, if viewed in plan (i.e. looking down on to the support plate 132). Other shapes and configurations are envisaged, e.g. defining a square, rectangular, triangular or other polygonal cross section, and/or defining a square, rectangular, triangular or other polygonal ring in plan view. The projection will ideally need to be rigid or be otherwise capable of withstanding the load placed on it from a fully filled FIBC 110, in order to remain 'projecting' status during a discharge operation.

The projection 133 can be incorporated into support plates 132 of planar configuration or curved or angled configuration (e.g. of the kind shown in FIGS. 11 and 12). The projection 133 can form part of support plates of the kind shown herein (i.e. having a diameter or defining an area less than the area of the underside of a fully filled container intended for use therewith), or can form part of support plates of the kind shown in PCT/GB2012/052880 in the name of the present applicant, the content of which is incorporated herein by reference (i.e. having a diameter or defining an area greater than the area of the underside of a fully-filled container intended for use therewith). The modified support plate 132 may be used in FIBC discharge apparatus or other forms of apparatus for use in discharging product from containers having an outlet, e.g. of the kind set forth herein or in PCT/GB2012/052880.

The invention claimed is:

1. A discharge assembly comprising:

a flexible bulk container having a base and an outlet channel extending from the base and having an outlet at one end through which product is to be dispensed, a seat having an upper surface onto which the base of the bulk container is supported for a discharge operation, the seat including an outlet region through which the outlet channel of the bulk container extends when seated thereon, wherein the upper surface is either flat or is curved downwardly from the outlet region towards an outer peripheral edge of the seat or angled downwardly from the outlet region towards the outer peripheral edge of the seat, a displacement member configured for movement away from the seat for agitation of the container, and a vibration unit for selectively vibrating the seat;

wherein an inner edge of the displacement member is spaced from the outer edge of the seat, to create a void into which the base of the container may sag, when the displacement member is in a retracted position such that the seat is configured for the base of the container to overhang and sag below a periphery of the seat when seated thereon.

2. The discharge assembly according to claim 1, wherein the base of the container has an area greater than the area defined by the periphery of the seat.

3. The discharge assembly according to claim 1, wherein the displacement member is concentric with the seat and has in internal diameter greater than the outer diameter of the seat.

4. The discharge assembly according to claim 3, wherein a flexible wall extends between the displacement member and the seat.

5. The discharge assembly according to claim 4, wherein the displacement member is configured to move from the retracted position to an extended position in which the wall defines a cone-shaped passageway for directing a flow of product from the container.

6. The discharge assembly according to claim 1, wherein the spacing between the displacement member and the seat in the retracted position is at least in the region of 100 mm.

7. The discharge assembly according to claim 1, comprising one or more actuators for movement of the displacement member relative to the seat.

8. The discharge assembly according to claim 1, comprising a detector for detecting product flow rate, an actuator for selectively raising the displacement member relative to the seat, and a controller configured to receive a signal from the detector and send a signal to the actuator indicating when the displacement member should be raised.

9. The discharge assembly according to claim 1, comprising a frame from which the container is suspended in order to sit on the seat.

10. The discharge assembly according to claim 9, wherein the frame comprises two parts: an upper part for connection of the upper end of the bulk container and a lower part including the seat.

11. The discharge assembly according to claim 10 wherein the upper part is movable relative to the lower part, for lifting the upper end of the bulk container away from the seat.

12. The discharge assembly according to claim 1, wherein the seat includes a projection proximal yet spaced from said outlet region, which extends from an upper surface of the seat.

13. The discharge assembly according to claim 12, wherein the projection is spaced from the outlet by at least 30 mm.

14. The discharge assembly according to claim 12, wherein the projection is annular and concentric with a through axis of the outlet region.

15. A discharge assembly comprising:

a flexible bulk container having a base and an outlet channel extending from the base and having an outlet at one end through which product is to be dispensed;

a seat onto which the base of the bulk container is seated for a discharge operation, the seat including an outlet region through which the outlet channel of the bulk container extends when seated thereon, wherein the seat is configured for the base of the container to overhang and sag below a periphery of the seat when seated thereon;

a vibration unit for selectively vibrating the seat;

a displacement member configured for movement away from the seat for agitation of the container; and a detector for detecting product flow rate, an actuator for selectively raising the displacement member relative to the seat, and a controller configured to receive a signal from the detector and send a signal to the actuator indicating when the displacement member should be raised.

* * * * *